United States Patent [19]

Campbell

[11] 4,300,325

[45] Nov. 17, 1981

[54] HOLDER ASSEMBLY FOR CASE PACKING MACHINE

[75] Inventor: Barry Campbell, Spokane, Wash.

[73] Assignee: R. A. Pearson Company, Spokane, Wash.

[21] Appl. No.: 88,052

[22] Filed: Oct. 24, 1979

Related U.S. Application Data

[63] Continuation-in-part of Ser. No. 955,350, Oct. 27, 1978, Pat. No. 4,259,826.

[51] Int. Cl.[3] ..... B65B 39/08; B65B 35/56; B65B 5/08

[52] U.S. Cl. ..... 53/143; 53/247; 53/248

[58] Field of Search ..... 53/248, 48, 261, 262, 53/497, 143, 539, 543, 247, 300, 142, 69, 80, 761, 762, 763; 294/87.22

[56] References Cited

U.S. PATENT DOCUMENTS

| | | | |
|---|---|---|---|
| 3,057,136 | 10/1962 | Walter | 53/248 X |
| 3,443,355 | 5/1969 | Birrell | 53/544 X |
| 3,452,508 | 7/1969 | Dzenis | 53/247 X |
| 3,694,993 | 10/1972 | East | 53/248 X |
| 3,702,524 | 11/1972 | Johnson et al. | 53/248 X |
| 3,864,890 | 2/1975 | Ullman | 53/247 X |
| 3,869,843 | 3/1975 | Darrah et al. | 53/247 X |
| 3,926,336 | 12/1975 | Graham et al. | 221/296 |
| 3,982,662 | 9/1976 | Graham | 221/296 |
| 3,991,539 | 11/1976 | Luca | 53/248 X |
| 4,035,986 | 7/1977 | Clem et al. | 53/248 X |
| 4,171,603 | 10/1979 | Wiseman | 53/248 |

FOREIGN PATENT DOCUMENTS

| | | | |
|---|---|---|---|
| 382376 | 10/1932 | United Kingdom | 53/248 |

*Primary Examiner*—Horace M. Culver
*Attorney, Agent, or Firm*—Wells, St. John & Roberts

[57] ABSTRACT

A holder assembly is described for releasably receiving and supporting successive groups of containers in a case packing machine. The machine is operable to move successive groups vertically downward from a first station to the holder assembly at a second station. Subsequently the containers are forced downwardly again from the holder assembly to a case packing station below. The holder assembly functions to group received containers into defined rectangular clusters. The holder assembly also permits vertical movement of the containers while holding them in the rectangular array. Rotary mechanisms enable selective inversion of the holders and containers supported within.

19 Claims, 15 Drawing Figures

FIG 13
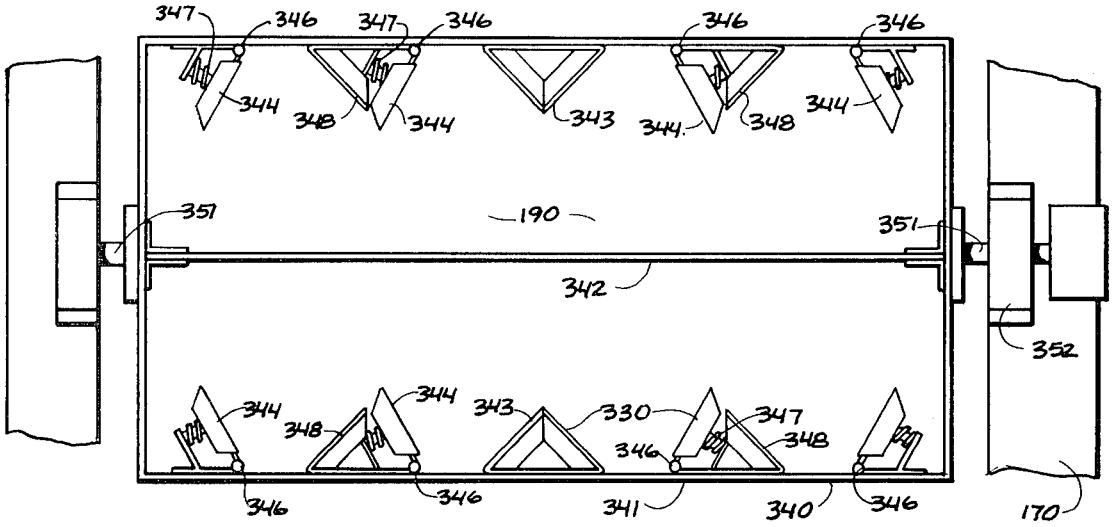
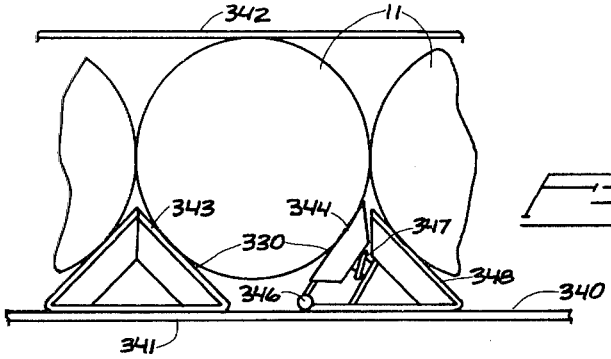
FIG 14
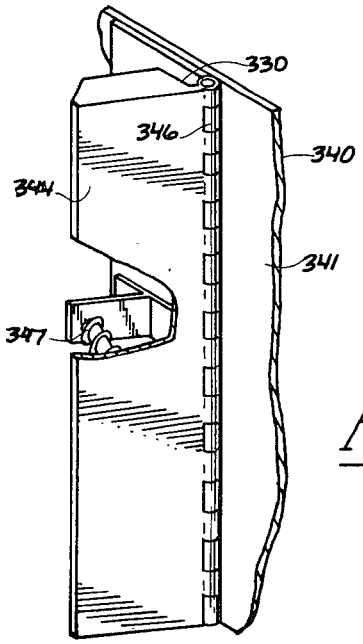
FIG 15

HOLDER ASSEMBLY FOR CASE PACKING MACHINE

This is a Continuation-in-Part of application Ser. No. 955,350 filed Oct. 27, 1978 now U.S. Pat. No. 4,259,826 and titled "Case Packing Machine".

BACKGROUND OF THE INVENTION

The present invention is used in conjunction with a machine for packing groups of containers, preferably bottles, within open cases.

Lightweight plastic disposable bottles for beverages or other fluids are currently becoming popular in the bottling industry. Such bottles are easily damaged in handling and are not easily packed horizontally into cases. It is more desirable to move the bottles vertically but the lightweight bottles will not fall freely and predictably. It therefore becomes desirable to provide some form of case packing machine that will automatically load groups of such bottles vertically into cases while maintaining full control over the bottles. It also becomes desirable to provide some form of holder for receiving and guiding the bottles as they are moved downwardly.

It is often desirable to pack cases with bottles in inverted positions (open ends down) when there is chance that debris may fall into the otherwise open bottles. The disclosed machines will pack bottles automatically into cases and are selectively operable to invert groups of bottles prior to packing.

DESCRIPTION OF THE DRAWINGS

FIG. 13 is a fragmentary plan view of an alternate form of the present holder;

FIG. 14 is an enlarged fragmentary view of the holder shown in FIG. 13 showing placement of bottles therein; and FIG. 15 is a pictorial detail of a portion of the holder shown by FIGS. 13 and 14.

DETAILED DESCRIPTION OF PREFERRED AND ALTERNATE EMBODIMENTS

Figure 1:
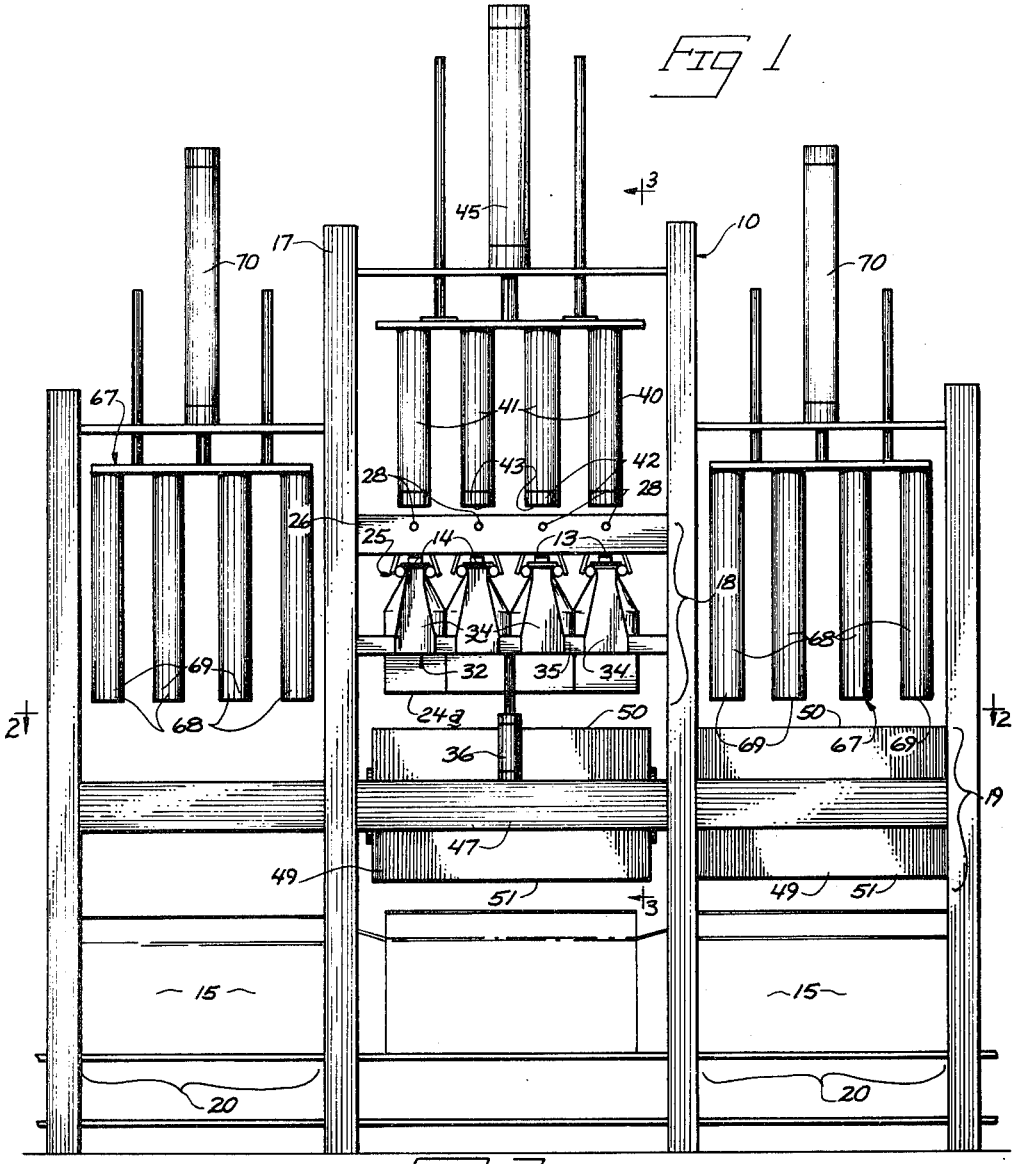
FIG. 1 is a front elevational view of a first form of case packer.
Figure 8:
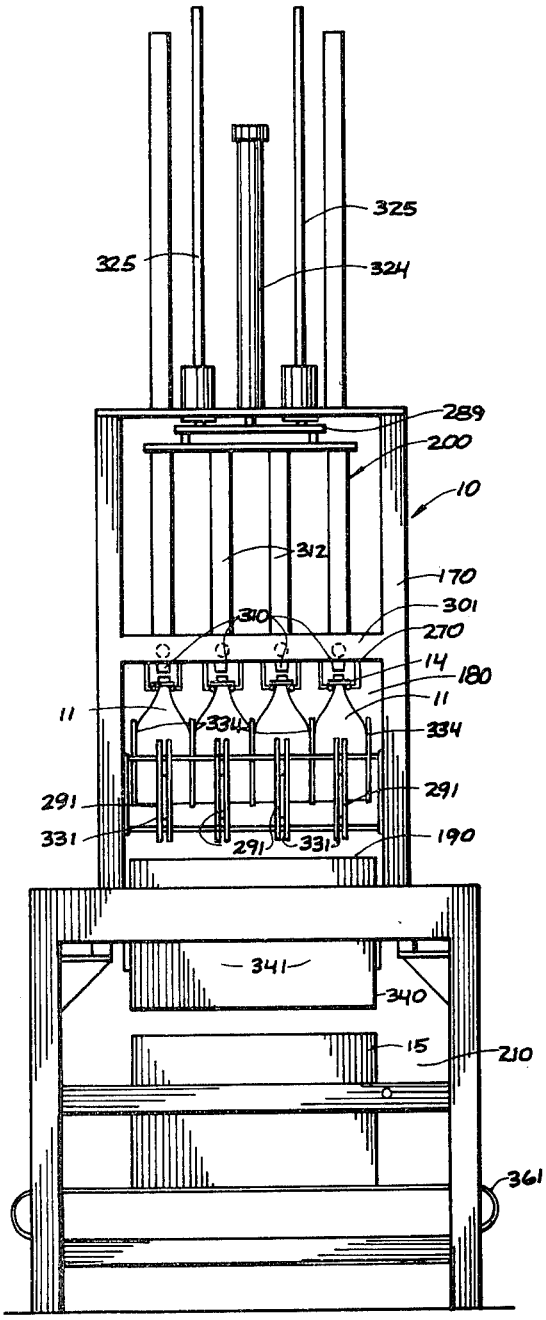
FIG. 8 is a front elevational view of an alternate case packing machine.
Figure 9:
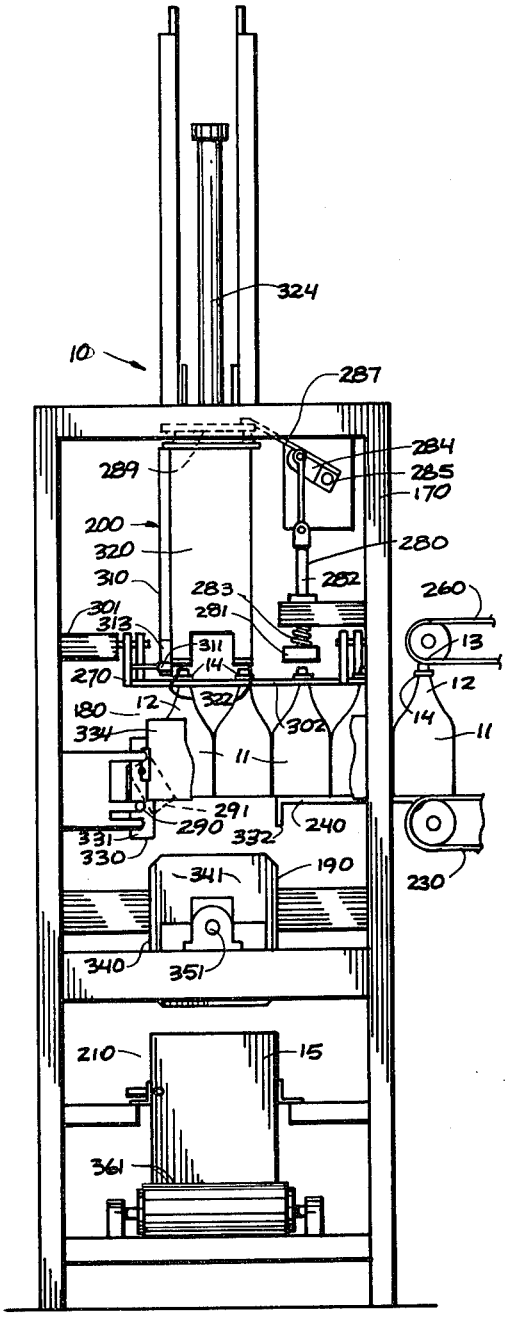
FIG. 9 is a side elevational view of the alternate machine.
Figure 11:
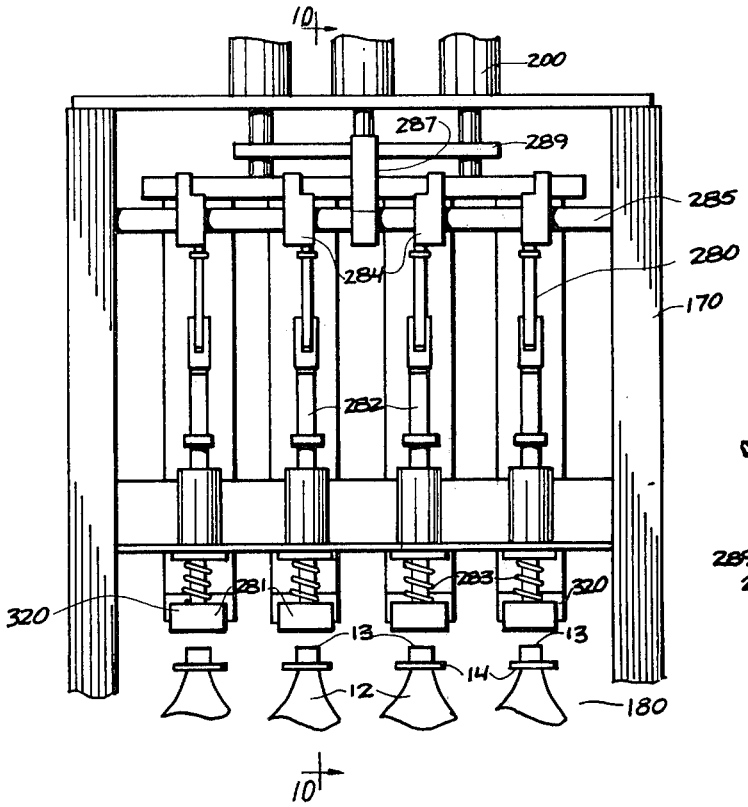
FIG. 11 is a fragmentary rear elevational view of the bottle stop mechanism shown in FIG. 10.
Figure 10:
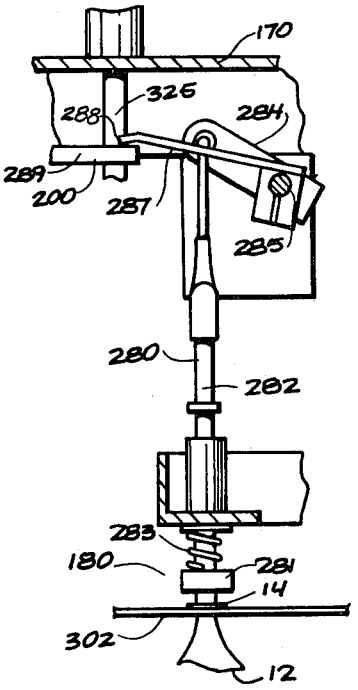
FIG. 10 is a fragmentary detailed view illustrating a bottle stop mechanism taken on line 10—10 in FIG. 11.
Figure 12:
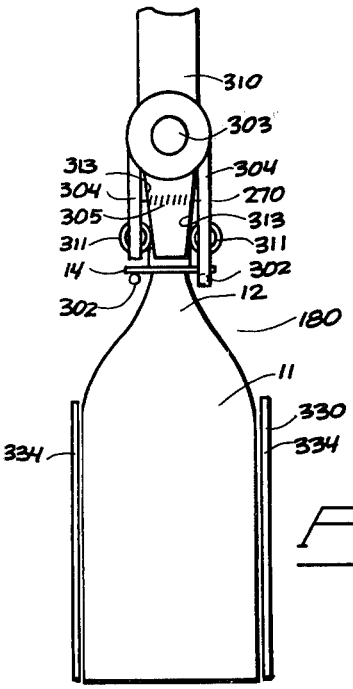
FIG. 12 is a fragmentary elevation view of an escapement mechanism.

Case packers including alternate forms of the present invention are designated generally in the drawings by the reference character 10. Both case packers are designed for handling containers, especially bottles such as those diagrammatically illustrated at 11. Each bottle includes a reduced neck 12 leading to a "finish", that includes an enlarged neck flange 14. The bottles are automatically collected by the machines and placed into upwardly open cases 15 (FIGS. 1 and 8).

The individual embodiments of the present invention will be described separately below. The first embodiment is shown in FIGS. 1–7. The second embodiment is shown by FIGS. 8–15.

FIRST EMBODIMENT

The first form of case packer 10 is supported by a general framework 17 which defines several work stations at which the different processes are performed for packing successive groups of bottles 11 into the cases 15. The stations are separated elevationally. The first station 18 initially receives bottles entering the machine. A second station 19 is situated elevationally below station 18. Bottles are transferred from the first station 18 to the second station 19 by operation of a ram means 40.

Figure 2:
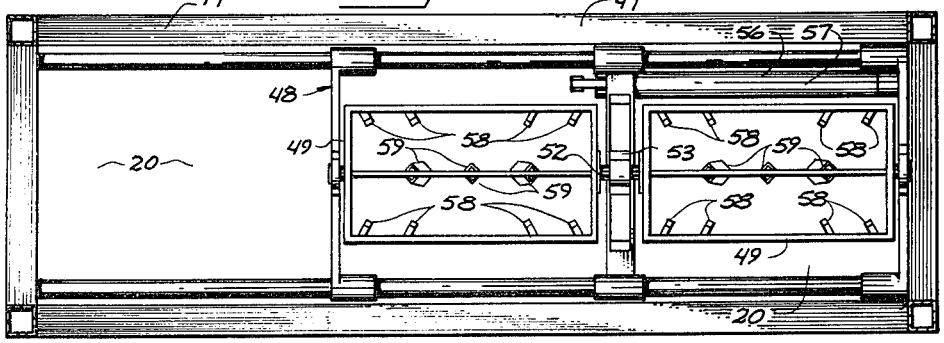
FIG. 2 is a sectional view taken along line 2—2 in FIG. 1.
Figure 3:
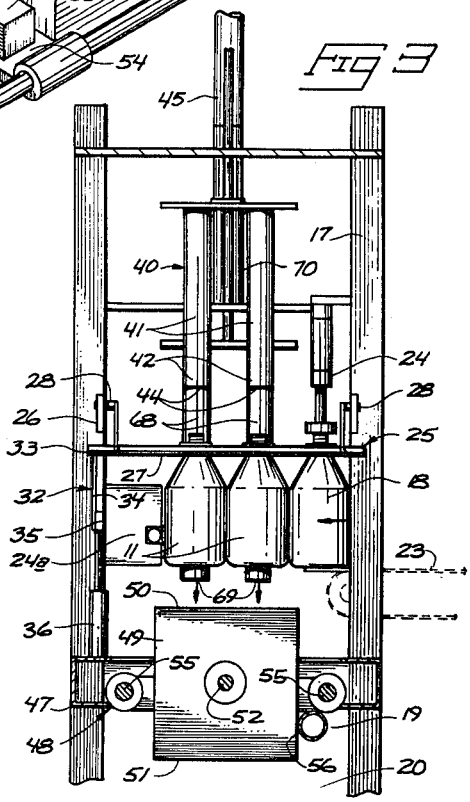
FIG. 3 is a sectional view taken along line 3—3 in FIG. 1.

The second station as illustrated by FIGS. 1–3 is an intermediate station at which successive groups of bottles are received and shifted horizontally to be deposited at the case packing station. Groups of bottles at the second station are guided downwardly to a case packing station 20 below. In instances where the first and second stations 18, 19 are arranged in vertical fixed alignment (as described below in an alternate embodiment) only a single packing station 20 need be provided. Bottles entering the second station can be used to eject a prior group of bottles at the second station so as to move the group of bottles into a case at the packing station. In the first embodiment, though, it is preferred to use two case packing stations 20 below second station 19 and on opposite sides of the first station 18. The bottles are moved downwardly by plungers 68 from the second station 19 into cases 15 that are situated at the packing stations 20.

The following, more detailed description will be given in the arrangement of the stations for the first form of the invention briefly discussed above.

The First Station

Individual bottles are fed horizontally to the case packer 10 at the level of the first station 18. FIG. 3 illustrates a horizontal infeed conveyor 23 by dashed lines. The conveyor 23 may be any appropriate form of pallet type conveyor utilized for moving bottles horizontally. The working flights of such conveyors will slide beneath the bottles as they meet resistance to further motion. A bottle stop mechanism 24 may be provided on the frameworks 17 for this purpose. A stop and sensing mechanism **24*a* is provided to detect whether a selected number of bottles has been delivered to the first station 18. If so, the bottle stop and cylinder arrangement 24 may be operated to prevent further progress of the bottles on the infeed conveyor 23. The movable stop engages the upper surfaces of a row of bottles adjacent the first station 18 to hold further bottles on the conveyor 23 during transfer of the grouped bottles from first station 18 to second station 19. The stop mechanism 24 will automatically release to allow infeed of a subsequent group of bottles once the prior group has been shifted to the second station 19**.

Conveyor 23 feeds an escapement mechanism 25, situated at the first station 18 to alternately receive and release the successive groups of bottles. The escapement mechanism 25 is mounted along an escapement framework 26 that is an integral part of the general framework 17. Mechanism 25 includes at least one pair of elongated parallel escapement bars 27. Bars 27 extend horizontally from the infeed conveyor 23. Bottles are fed between the bars 27 by continuous pressure from the bottles on conveyor 23 and are engaged and supported at their enlarged shoulders 14.

Figure 5:
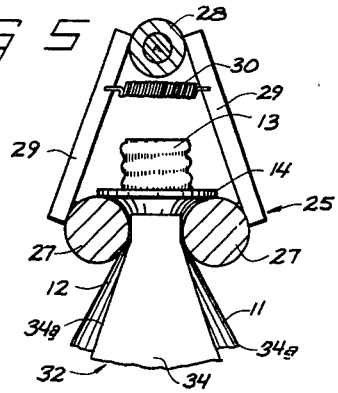
FIG. 5 is a fragmentary operational view.
Figure 6:
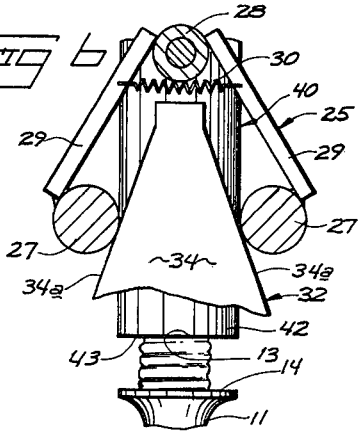
FIG. 6 is a view similar to FIG. 5 showing different operational positions of the elements therein.

A pivot 28 mounts the elongated escapement bars 27 for movement between a first position for receiving and suspending successive groups of bottles (FIG. 5) and a second position for releasing the successive groups (FIG. 6). Connecting members 29 extend between pivot 28 and escapement bars 27. Members 29 permit pivotal movement of the bars 27 about the horizontal axis of the pivot 28. A tension spring 30 is provided for each pair of connecting members 29. The springs interconnect the adjacent members 29 and therefore urge the escapement bars 27 toward their normal bottle-engaging positions (FIG. 5).

An actuating means is generally designated by numeral 32. Means 32 functions to selectively move the escapement bars 27 about the pivot axis between the two positions. Means 32 may include cam followers 33 mounted at outward ends of the bars 27 (FIG. 3). Cams 34 are positioned between the followers 33 and are moved in a vertical path to move the followers 33 between the first and second positions. Cams 34 may be mounted to a cam carriage 35 and moved by a jack means.

The jack means is comprised of a cylinder 36 that interconnects the carriage 35 and framework 17. It will therefore move the cams 34 elevationally relative to the cam followers 33. Opposed cam surfaces 34*a* are provided on each cam member 34 that are formed along lines that converge toward the axes of the pivots 28. The cam surfaces 34*a* form equal angles on opposite sides of central vertical planes through the vertical axes of containers held by the bars 27 and the axes of pivots 28. The cams move vertically to separate the paired bars against the resistance offered by springs 30 until the bars are separated by a distance greater than the width of the bottle neck flanges. The bars will move apart in unison and will simultaneously disengage, allowing the bottles to drop vertically.

A ram means 40 is provided to engage the bottles at the instant of their release from the escapement mechanism and to forcibly move the bottles downwardly to the second station 19. The ram means is generally designated at 40 and includes a plurality of vertically oriented plungers 41. A single plunger 41 is provided for each bottle of a group selected to be packed by the present machine.

Plungers 41 are substantially cylindrical. Each plunger includes a lower end 42 for engaging an individual bottle. The lower ends 42 are arranged along a horizontal plane. Each end 42 includes a horizontal bottom surface 43 (FIG. 6). The surfaces 43 are aligned with the finishes of bottles 11 that have been received and positioned on the escapement bars 27. The plungers 41 releasably receive and guide the bottles via surfaces 43 downwardly to the second station 19. A cylinder 45 is provided to move the plungers 41.

Appropriate conventional switching mechanisms may be provided operatively connecting the actuating mechanisms for cylinders 36 and 45 so the plungers 41 will be lowered to engage the bottles at the instant they are released by the escapement bars 27. The rate of descent for the plungers 41 is preferably greater than the free fall rate for a single empty bottle. This assures that control of the bottles will be maintained as they are moved from the elevation at first station 18 to the lower intermediate elevation at the second station 19.

The Second Station

As discussed above, the second station 19 is situated intermediate the first station and the case packing stations. Alternate groups of bottles received at the second station are laterally shifted to areas at each side of the first station. This lateral shifting movement may be accomplished after the cylinder 42 has returned to its normal illustrated position, as the escapement mechanism is receiving a group of bottles, and as the elements associated therewith are being readied to discharge the bottles to the second station.

A bottle holder assembly is provided at the second station 19 for receiving and guiding successive groups of bottles downwardly to the cases at the packing stations 20. The bottle holder assembly includes a guide means for lateral movement to positions above the case packing stations 20. The guide means may include a supporting frame section 47 that is integral with the general framework 17.

The holder assembly includes first and second laterally spaced hollow box framed holders 49. The holders 49 are spaced so that one holder 49 will be positioned directly below the first station 18 while the remaining holder 49 is positioned at a location overlying one of the case packing stations 20. One holder 49 can therefore receive a group of bottles while the bottles held by the remaining holder 49 are being discharged into a waiting case.

Figure 4:
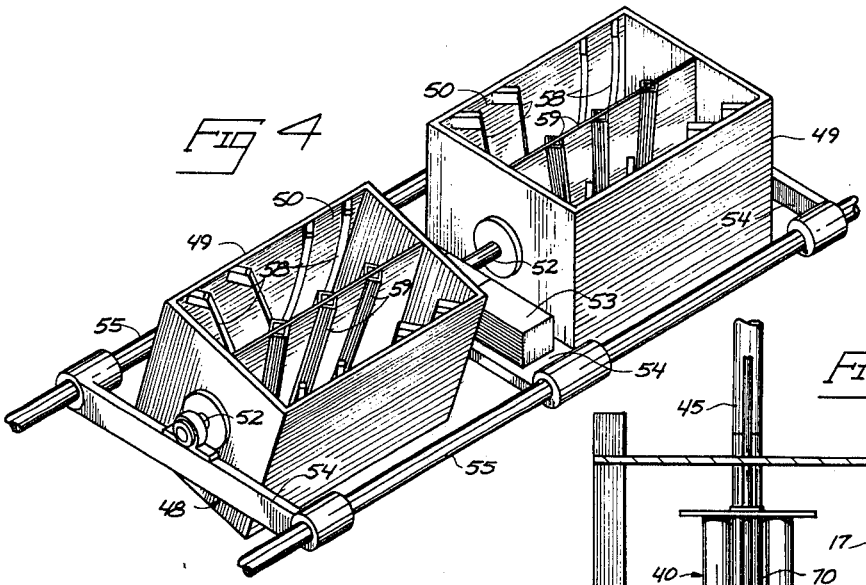
FIG. 4 is a fragmentary pictorial view of the present invention.
Figure 7:
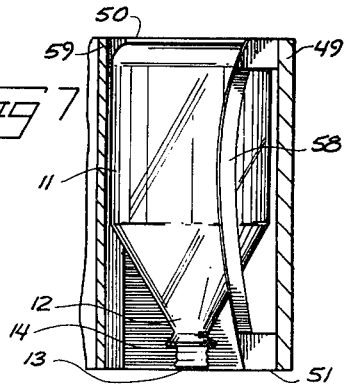
FIG. 7 is an enlarged fragmentary detail of a holder showing a bottle held in an inverted position.

The holders 49, as shown in FIGS. 4 and 7, include horizontal open upper and lower ends 50 and 51 that allow bottles to pass vertically through. Bottles are releasably retained as a group within the holders by spring or solid biased guideways 58 and relatively stationary central guides 59.

The holders 49 may be selectively inverted by a rotary actuator 53 on a slide frame 54. Preferably, each holder 49 is independently pivotable about a horizontal central axis along coaxial shafts 52. Separate actuators may be used for the two holders 49 to permit one to be pivoted with respect to the other. Alternatively the holders may be fixed relative to each other so both will pivot in unison.

When bottles are to be inverted during transfer to a case, one holder may be initially inverted or turned 180° relative to the other. Subsequent inversion of the holders 49 in unison will then assure that one holder will be facing upward (under station 18) while the other is facing downward (above a case packing station 20). Holder inversion can be accomplished while the holders 49 are being shifted across the machine.

The slide frame 54 carries the holder 49 for reciprocating movement along a horizontal path between the case packing stations 20. The frame 54 is slidably carried by a pair of parallel guideways 55. Ways 55 are situated on opposite sides of the framework and are horizontal. They function as the guide means and define the path taken by the reciprocating holders 49.

Movement of the holders 49 is controlled by a drive means 56. Means 56 may include a hydraulic or pneumatic cylinder 57 (FIG. 2) fixed between the framework 17 and slide frame 54. Extension and retraction of the cylinder will cause corresponding translational movement of the holders 49. The length of stroke for the cylinder 57 is equal to the lateral spacing between either case packing station and the first station 18. Extension of cylinder 57 will thus bring one holder 49 to a location directly adjacent one of the case packing stations while the remaining holder 49 is directly below the first station 18.

The Case Packing Stations

As discussed above, there are two case packing stations spaced laterally from the first station 18. Successive groups of bottles are moved from the holders 40 at each of the stations and deposited into cases 15. A loading means 67 is provided to move the bottles from releasable engagement within the holders 49 and into the cases 15.

The loading means 67 includes a plurality of loading plungers 68. Plungers 68 are similar to the plungers 41 of the ram means 40. The number of plungers 68 is equal to the number of bottles carried in a group. Each includes a lower end 69 for engaging a bottle. It should be noted that the plungers 68 will operate effectively whether engaging the bottles at the finishes 13 or whether they are utilized to press against the bottoms of inverted bottles as shown in FIG. 7. Plungers 68 are powered to move vertically by cylinders 70. Extension of a cylinder 70 brings the associated loading plungers 68 vertically downward through the aligned holder 49 to push the bottles from engagement with the guideways 58 and 59. The spring biased guideways 58 and stationary central guides 59 function to maintain the bottles in a tight rectangular pattern as they are being guided into a case 15.

Operation

A group of bottles is fed horizontally to the first station 18 by the horizontal infeed conveyor 23. The sensing mechanism 24*a* is utilized to determine that a specified number of bottles have been received by the escapement mechanism 25. The bottle stop assembly 24 is then actuated to halt further forward horizontal progress of bottles on the conveyor 23 for sufficient time to allow movement of the previously positioned group of bottles into one of the holders 49.

The escapement mechanism 25 may be operated simultaneously with or slightly delayed from operation of the bottle stop mechanism 24. First, the actuating means 32 is operated to bring cams 34 upwardly into contact with the cam followers 33 on escapement bars 27. This forces the bars 27 apart until they release the enlarged neck flanges 24 of the group of bottles.

At the instant the bottles are released from the bars 27, the ram means 40 functions to bring the plungers 41 down into contact with the bottles to force the bottles downwardly to the second station 19 and a waiting holder 49.

The bottles are frictionally engaged within the holder between the spring biased guideways 58 and stationary central guides 59. This frictional engagement is sufficient to support the bottles during movement of the holder.

Retraction of the ram means 40 to its FIG. 1 position initiates, through suitable control devices, release of the bottle stop mechanism 24 and actuates cylinder 57 to shift the loaded holder to one or the other of the sets of loading plungers 68. The holder arriving at a position below the loading plunger 68 can be utilized to actuate the loading means 67. The plungers 67 will descend, engage the bottles, and force them downwardly from the holder 49 and into a case 15 waiting below.

The holder, after receiving a group of bottles from the escapement mechanism 25, may be pivoted 180° by the rotary actuator 53. Thus, the bottles will be inverted from their original positions and will be replaced in the case 15 in an inverted position. The holder can be returned to its original position as it is reciprocated back to receive its next successive group of bottles.

SECOND EMBODIMENT

The case packer of the FIGS. 8–14 embodiment is supported by a general framework 170 along which are defined several work stations. A different step in the process of loading the bottles into the cases is performed at each station. The several stations are separated elevationally. A first station 180 is where bottles initially enter the machine. A second station 190 is situated elevationally below station 180. Preferably, the second station 190 is vertically aligned with the first station 180.

Bottles are shifted from the first station 180 vertically to the second station 190. This is accomplished by a bottle ram means 200 which moves vertically, engaging bottles at the first station, and forcing them downward to the second station.

The second station 190 as illustrated is an intermediate station where bottles are received, gathered into defined rectangular clusters, and elevationally discharged. The defined clusters of bottles at the second station are guided downwardly to a case packing station 210 below.

The following, more detailed description of the second embodiment of the invention is given below following the arrangement of the successive stations.

The First Station

Individual bottles are fed horizontally to the case packer 10 at the level of the first station 180. FIG. 2 illustrates a fragment of a horizontal infeed conveyor 230 that is utilized to move the bottles horizontally toward station 180. The conveyor 230 may be an appropriate form of pallet type conveyor commonly utilized for moving bottles horizontally. Conveyor 230 leads horizontally to a stationary plate 240. The plate 240 is co-extensive of the working flight for conveyor 230 and includes a smooth upper surface for slidably receiving and supporting the bottles.

The working flight of the pallet conveyor 230 includes a smooth surface that will slide beneath the bottles if they meet resistance to further motion. A hold-down conveyor 260 is provided to assure fast forward motion of bottles along the conveyor 230. The hold-down conveyor 260 is mounted above the working flight of conveyor 230 to engage the bottle finishes 13.

Hold-down conveyor 260 is made up of a series of belts oriented parallel to the flights of conveyor 230. The speed of the belts is identical to that of conveyor 230. The hold-down belts are driven directly by conveyor 230. They function to hold the bottles upright and to prevent sliding of the bottles over the working surface of the pallet conveyor 230.

The hold-down conveyor 260 is spaced above the working flight of the infeed conveyor 230 so its working flights slidably engage the bottle finishes, and like the surface of conveyor 230, will slide over the engaged bottles as forward progress of the bottles is stopped on the conveyor. Both conveyors produce a continuous forward thrust against the bottles, urging them toward the first station 180.

The bottles will slide across the plate 240 and into engagement with an escapement means 270 (described below). As the escapement means 270 becomes full, further progress of the bottles on the conveyor and plate is halted. Both conveyors 230 and 260 then slide over the bottle surfaces while urging them toward the first station 180.

The bottle ram means 200 is operated to move the bottles from the escapement mechanism to the second station. During this time a stop means 280 operates to halt forward progress of the bottles across the plate 240. This frees the grouped bottles for vertical movement in response to actuation of the ram means between the first and second station and allows subsequent filling of the escapement means 270 as the stop means releases the bottles.

The stop means 280 is operational in response to operation of the bottle ram means 200. The bottle stop means is shown in substantial detail by FIGS. 3 and 4. Bottle stop means 280 includes a plunger pad 281 for each bottle in a transverse row on plate 240 directly adjacent the escapement means 270. The pads 281 are mounted at bottom ends of upright, vertically movable connecting rods 282. The pads are urged toward a downward, finish engaging position (FIG. 10) by compression springs 283.

Upper ends of the connecting rods 282 are pivotably mounted to crank arms 284. The arms 284 extend from ends mounting the connecting rods 282 to inward ends fixed to a pivotable rocker shaft 285. Pivotal movement of the rocker shaft 285 will therefore cause corresponding vertical movement of the connecting rods and plunger pads.

The stop means 280 is operated by a feeler 287 that is mounted rigidly to the rocker shaft 285 and extends outwardly to engage ram means 200. The feeler 287 extends to a free end 288 that pivots on the axis of rocker shaft 285 in response to engagement with a movable plate 289 of the bottle ram means 200. The feeler will pivot downwardly when the ram means descends. The compression springs urge the plunger pads 281 downwardly against the finishes of the bottles below, clamping them against the plate 240. The bottles thus clamped will act as abutments for the following bottles on plate 240, causing them to stop and back up the incoming bottles along the conveyors 230 and 260.

Subsequently, as the ram means is moved upwardly, the plate 289 contacts the feeler 287 and lifts it upwardly. This forces corresponding pivotal movement of the rocker shaft 287 and lifts the crank arms 284. The crank arms 284 lift the connecting rods 282 and plunger pads 281 against the resistance of the springs 283. The disengaged bottles are then free to slide from plate 240 and onto the escapement means 270.

Bottles being loaded onto the escapement means 270 are detected by a sensing mechanism, such as a photocell arrangement 290 (FIG. 9) mounted on the general framework 170. A series of apertured flags 291 are freely pivoted on the framework 170. Each flag is positioned to be engaged by a bottle as the escapement mechanism is being filled. The flag will pivot, in response to a forwardly moving bottle, to move its open aperture into alignment with a light beam produced at one side of the escapement mechanism. When each flag has been thus pivoted, the light beam will shine through the aligned apertures and be reflected, producing a signal through actuation of an appropriate photocell. Such signal indicates that the escapement mechanism has received a sufficient number of bottles to continue operation. The signal can also serve to initiate operation of the ram means. If an insufficient number of bottles are received, no signal will be produced and the ram means will not operate.

The conveyor 230 feeds the escapement means 270 which is situated at the first station 180 to alternately receive, suspend, and release successive groups of bottles. The escapement mechanism 270 is mounted along an escapement framework 301 that is an integral part of the framework 170. The escapement means 270 includes at least one pair of elongated parallel escapement bars 302.

Preferably, there is one pair of bars for each row of bottles received from the infeed conveyor 230. Thus, as shown in FIG. 1, there are four pairs of bars for four rows of bottles. The bars 302 extend horizontally from and parallel to the infeed conveyor 230.

The bottles are engaged and suspended from their neck flanges 14. Bottles slide between the escapement bars 302 by continuous pressure from the bottles on conveyors 230 and 260. FIG. 5 indicates the point of engagement between a bar 302 and a bottle neck flange 14 engaged thereby.

A pivot 303 mounts each pair of the elongated escapement bars 302. The bars 302 are mounted on the pivots for movement between closed positions for receiving and suspending successive groups of bottles, and open positions for releasing the successive groups.

Connecting members 304 extend between the pivots 303 and escapement bars 302. The connecting members 304 permit pivotal movement of the bars 302 about the horizontal axis of the pivots 303. A tension spring 305 is provided for each pair of connecting members 304. The springs 305 interconnect the adjacent connecting members 304 and urge the associated escapement bars 302 toward their normal closed bottle engaging positions.

An escapement actuator means is generally designated by the numeral 310. It functions to selectively move the escapement bars 302 about the pivot axes of pivots 303 between the two positions. This is done directly in response to movement of the bottle ram means 200.

The escapement actuator means 310 may include cam followers 311 mounted at outward ends of the escapement bars 302. The cam followers 311 are shown as rollers freely rotatable about axes parallel to the escapement bar pivot axes. Cams 312 are mounted to the bottle ram means for vertical movement therewith. The cams 312 include inclined cam surfaces 313 for engaging and operating against the cam followers 311. The cam surfaces 313 are formed in wedge configurations and move vertically between each follower of a pair of escapement bars 302. The surfaces 313 will urge the followers apart upon movement of the cams, and will allow the followers to move toward one another due to tension of the springs 305 as the cams are elevated with the bottle ram means 200.

Timing of the bottle release from the escapement means 270 is determined by the vertical positioning of the cams on the bottle ram means. It is preferred that the cams operate to separate the escapement bars momentarily before the bottle finishes are engaged by the ram means. Such timing will assure contact and controlled descent of the grouped bottles from the first to the second position. The cams 312 are movably mounted to the bottle ram means 200 to enable selective timing of the bottle escapement release and engagement of the bottles by the ram means.

The bottle ram means 200 includes a plurality of vertically oriented plungers 320. A single plunger is supplied for each line of bottles on the escapement means 270. Each plunger further includes a distended lower end having pads 322 mounted thereon. The pads 322 are preferably formed of a resilient material so as not to damage the bottle finishes. and move downwardly with the remainder of the ram means to urge the bottles from the first to the second station.

Movement of the ram means 200 is accomplished by an upright cylinder 324 mounted to the general framework 170. The cylinder 324 is connected directly to the interconnected upper ends of plungers 320 by plate 289. Extension of the cylinder vertically will cause corresponding downward movement of plunger 320. This downward movement is guided by rods 325 on opposite sides of cylinder 324. Appropriate switches and control mechanisms (not shown) may be provided along the path of the cylinder piston or along the guide rods 325 in order to effectively control sequential operation of the present packer.

A substantial advantage is gained through the direct mechanical interconnection of the stop means 280 and escapement actuator means 310 with the bottle ram means 200. First, operation of both the stop means and the actuator means can be precisely timed in relation with the ram means. Furthermore, the drive mechanisms operating the ram means (cylinder 324) is also utilized to operate the stop means and escapement actuator. Therefore, separate drive and control mechanisms for these elements are eliminated, along with the resulting complexity of construction, operation and maintenance.

The Second Station

As discussed above, the second station 190 is situated directly below the first station 180. Here, bottles are received in successive groups by a guide means 330. The guide means 330 broadly includes several elements that are utilized to receive and direct movement of the bottles from the first to the second station.

The first guiding elements are upright guide members 331 adjacent the forward side of the first station. Also, at the first station is a lip 332 (FIG. 9) on plate 240 at the back side of the first station to prevent backward movement of the bottles and to guide them vertically downward. Lateral movement of the bottles is prevented at the first station by partitions 334. Partitions 334 extend parallel to the paths of the bottles on the conveyor 230. The partitions are shown particularly in FIGS. 8 and 9.

A holder assembly 340 is situated at the second station for receiving the groups of bottles from the above guides and for collecting the groups into defined rectangular clusters. The holder assembly 340 is preferably mounted for pivotal movement about a horizontal axis so that successive clusters of bottles may be inverted prior to being discharged into a case waiting below.

The holder assembly 340 is shown in substantial detail in FIGS. 12 through 15. It basically includes a box frame 341 having opposed horizontal open ends. The frame 341 is shown in plan view in FIG. 6 with a central vertical partition 342 evenly dividing the interior. Triangular upright center guides 343 are fixed to opposite sides of the box frame and face inwardly toward the center dividing wall 342. The guides 343 are centered on the long sides of the rectangular box frame. Their outwardly facing stationary sides serve to engage and guide bottles downwardly in addition to assisting with the forming of groups of bottles into rectangular clusters.

Bottle engaging plates 344 are spaced along the walls of the box frame 341 to opposite sides of the center guides 343. Bottle engaging plates 344 are flared at opposed ends to receive and guide individual bottles toward the vertical surfaces of the plates. The bottle engaging plates 344 are pivoted about vertical axes by hinges 346. These hinges are preferably "piano" hinges with a base of each fixed directly to the box frame 341. Springs 347 are situated between the hinge base plates and the pivotal bottle engaging plates 344. The springs 347 yieldably urge the plates 344 and the bottles engaged thereby toward the central wall 342 and toward engagement with the remaining bottles of the cluster. The spring tension can be adjusted to accommodate different sizes of bottles.

The bottle engaging plates 344 that are situated along the box frame sides directly adjacent to the triangular upright center guides 343 include stationary back guide surfaces 348. The back guide surfaces 348 are vertical. They function, as shown in FIG. 14 to direct bottles inwardly toward adjacent bottles held against the center guides 343 and inwardly toward the central wall 342. The desired rectangular cluster of bottles is thereby formed as the bottles are moved downwardly from the first station.

The central wall 342, plates 344 and back guide surfaces cooperate to hold a received group of bottles in a defined cluster, suspending them above the case packing station. Frictional engagement is such that the bottles can be forced downwardly through the lower open end of the box to the case packing station below. A subsequent received group of bottles can therefore be used to push the first set downwardly to the case packing station.

The box frame 341 is mounted by pivot shafts 351 to the general framework 170. A rotator means 352 is provided to rotate the box about the horizontal axis of pivot shaft 351 through an arc of 180°. The means 352 may be comprised of a conventional double acting rotary actuator, connected directly between the frame and the pivot shafts 351. Bottles held upright by the box can therefore be inverted prior to being discharged into a case below. The next group of bottles entering the box pushes the inverted bottles into the waiting case. The bottles located within the box can then be rotated through the 180° arc as the holder 340 is pivoted back to its original position. This oscillating motion may continue so long as it is desired to fill cases with inverted bottles. Of course, if it is desired to pack bottles upright into cases, it is not necessary to rotate the holder.

The Case Packing Station

There is a single case packing station spaced directly below the first station 180 where successive groups of bottles are moved from the holder 340 and deposited into a case 15. Means is provided in the form of a common horizontal conveyor 361 for positioning successive cases 15 at the case packing station. The conveyor 361 can be timed by conventional controls (not shown) to stop successive cases at the loading station in coordination with operation of the remainder of the case packer.

Each case on the conveyor will thus receive a cluster of bottles from the holder.

Operation

A group of bottles is fed horizontally to the first station 180 by the horizontal infeed conveyor 230. The holddown conveyor 260 will engage the bottle finishes to hold the bottles upright as they move quickly onto the escapement mechanism of the first station 180. The sensing mechanism is utilized to determine that a specific number of bottles have been received by the escapement means 270. An operational cycle of the ram means 200 is then initiated. The descending ram means also causes corresponding operation of the escapement actuator means 310 and the stop means 280.

The downwardly moving ram allows the feeler 287 to pivot downwardly. The compressed springs 283 of the stop means 280 are then free to urge the plunger pads 281 down against the finishes of bottles resting on the plate 240. The clamped bottles will thus block further forward movement of bottles on the infeed conveyor 230. These bottles will remain stationary with the working surfaces of conveyor 230 and hold-down conveyor 260 simply sliding over the engaged bottle surfaces. The conveyors therefore continuously urge the bottles toward the first station and, when the stop means is later released, will quickly move the bottles forwardly to again fill the escapement mechanism.

The escapement mechanism 270 also functions in response to movement of the ram means either simultaneously with or slightly delayed from operation of the bottle stop mechanism. The downwardly moving actuator means 310 operates as the cams 312 move downwardly with the ram means 200 into contact with the cam followers 311 on escapement bars 302. The cams force the bars 302 apart until they release the enlarged neck flanges 14 of the bottle group.

The ram plungers contact the bottle finishes at the instant the bottles are released from the bars 302. The plungers force the bottles downwardly along the guide means 330 to the second station 190. Movement of the plungers is preferably greater than the rate at which the bottles could free fall upon being released from the escapement bars. This assures positive bottle control by the ram means from the first to the second station.

The bottles being moved downwardly are guided from the first station by the upright guides 331, the lip 332 of plate 240, and the spaced partitions 334. The substantially rectangular pattern of the group is thereby maintained as the plungers move the bottles downwardly.

The bottles are received and urged into a defined, rectangular pattern as they are received at the second station within the holder 340. The group of bottles is moved through the upwardly open box frame end and into engagement with the triangular upright center guides 343 and the bottle engaging plates 344. The bottles are held in the defined cluster within the box frame 341 as the ram means 200 is retracted upwardly.

Upward movement of the ram brings the cams 312 out of engagement with the cam followers 311. This allows the springs 305 to return the escapement bars 302 to their normal closed condition. The upwardly moving ram means brings the plate 289 into engagement with the feeler 287. The upwardly pivoting feeler pivots the rocker shaft 285 and lifts the bellcrank arms 286. The arms 286, in turn, lift the plunger pads 281 from engagement with the bottles below. The released bottles are then free to slide over the plate 240 and onto the escapement bars 302, filling the escapement means 270.

Subsequent reactuation of the ram means 200 brings a repeat of the operation as described above for the first group of bottles (which are now presently waiting within the holder 340). The subsequent group of bottles is moved downwardly by the bottle ram means 200 to engage the cluster of bottles within the holder, pushing them downwardly from the holder and into a case waiting below on the conveyor 361. This completes a full cycle in the operation in which a group of bottles is moved from the infeed conveyor, through the case packing machine, and into a case.

The above operation may be somewhat altered by the rotational capability of the holder 340. For example, the holder may receive a group of bottles from the ram means, and as the ram means is retracting upwardly, the rotator means 352 may be actuated to cause a 180° movement of the holder 340. The first cluster of bottles is thus held inverted by the box frame. A subsequent group of bottles moved downwardly by the ram means will thus engage the bottoms of the inverted bottles, pushing them in the inverted positions downwardly into a case. The bottles received by the holder are upright. Pivotal movement of the holder back to its original angular position will thus cause inversion of the subsequently received cluster of bottles.

It should be noted that the above description and attached drawings are given merely as examples to set forth a preferred and an alternate form of the present invention. The following claims are to be taken as limitations upon the scope of the invention.

What is claimed is:

1. In a case packing machine for moving successive groups of containers lengthwise from a first station to a spaced second station and subsequently to a case packing station along a case packing framework, a holder assembly for releasably receiving and supporting a group of containers in a defined rectangular cluster at the second station, comprising:

a hollow box frame on the case packing framework at the second station and having opposed open ends;

fixed guide means arranged within the box frame perpendicular to its open ends for slidably engaging the side surfaces of a plurality of containers passing as a group in reversible directions alternatively through either of its open ends;

and spring biased guide means movably mounted within the box frame and spaced from the fixed guide means to urge the received containers individually against the fixed guide means and to frictionally engage the containers in a defined rectangular cluster supported within the box frame.

2. The invention as set out by claim 1 further comprising:

guide means mounting the hollow box frame to the case packing framework for conjoint movement between two alternate positions relative to the case packing framework.

3. The invention as set out in claim 1 further comprising:

rotary actuator means for pivoting the box frame relative to the case packing framework about an axis parallel to its open ends to invert containers held therein.

4. The invention as set out by claim 1 further comprising:

guide means mounting the hollow box frame to the case packing framework for conjoint movement between two alternate positions relative to the case packing framework; and rotary actuator means for pivoting the box frame relative to the case packing framework about an axis parallel to its open ends to invert containers held therein.

5. The invention as set out in claim 1 wherein the box frame includes a rigid partition perpendicular to its open ends and dividing its interior in half, for slidable engagement by containers supported within the box frame while engaged by the fixed guide means and spring biased guide means.

6. The invention as set out by claim 1 wherein the box frame is situated at a fixed position on the framework immediately below the first station;

said spring biased guide means including guide plates within the box frame arranged perpendicular to the open ends and facing inwardly toward the fixed guide means to slidably engage the sides of containers.

7. The invention as set out by claim 6 wherein the guide plates are hinged to the box frame for pivotal movement about axes perpendicular to its open ends.

8. The invention as set out by claim 6 wherein the guide plates are hinged to the box frame for pivotal movement about upright axes.

9. The invention as set out by claim 6 wherein the guide plates are yieldably bowed inwardly to engage and slide over side surfaces of containers placed within the box frame.

10. The invention as set out by claim 6 further comprising means for rotating the box frame about a fixed axis.

11. The invention as set out by claim 6 wherein the guide plates are flared at their ends to facilitate insertion and removal of containers.

12. In a machine for moving successive groups of bottles having cylindrical side surfaces, a holder assembly for receiving and supporting a group of containers in a defined cluster, comprising:

a supporting framework;

a hollow frame movably mounted on the framework, said frame having opposed open ends adapted to both receive and discharge groups of bottles passing as a group in reversible directions alternatively through either open end;

and spring biased means on said frame for frictionally gripping the cylindrical side walls of each bottle received within the frame and for maintaining it within a defined cluster during subsequent movement of the frame relative to the framework.

13. The invention as set out in claim 12, further comprising:

fixed means arranged within the frame for slidably engaging the cylindrical side walls of each bottle while the bottle is frictionally gripped by the spring biased means.

14. The invention as set out in claim 12, further comprising:

rotary actuator means operably connected between the framework and the frame for selectively pivoting the frame relative to the framework about an axis parallel to the frame open ends.

15. In a machine for moving successive groups of bottles having cylindrical side walls, a holder assembly for receiving and supporting a group of containers in a defined cluster, comprising:

a supporting framework;

a hollow rectangular box frame having a pair of transversely spaced side walls spanned by end walls, said side walls and end walls having open peripheral edges about opposed open ends;

a center dividing wall extending parallel to the side walls of the box frame between said pair of end walls;

spring biased guides mounted within the box frame alongside the path of movement of each bottle received or discharged in reversible directions alternatively through either of the open ends of the box frame, said guides each having an inwardly facing surface adapted to frictionally engage the cylindrical side walls of a bottle located within the box frame.

16. A machine as set out in claim 15, further comprising:

fixed guides mounted within the box frame alongside the path of movement of each bottle in opposition to the spring biased guides, said fixed guides each having an inwardly facing surface adapted to frictionally engage the cylindrical side walls of a bottle located within the box frame.

17. A machine as set out in claim 16, wherein the spring biased guides and fixed guides are arranged in pairs across the side walls of the box frame.

18. A machine as set out in claim 16, wherein the spring biased guides and fixed guides are arranged in pairs across the side walls of the box frame and each includes angularly disposed surfaces along planes perpendicular to the open ends of the box frame and facing toward the center dividing wall.

19. The invention as set out in claim 15 wherein the spring biased guides each includes a plate hinged to a box frame side wall about an axis perpendicular to the open ends of the box frame.

* * * * *

REEXAMINATION CERTIFICATE (229th)

United States Patent [19]

Campbell

[11] B1 4,300,325

[45] Certificate Issued Jul. 24, 1984

[54] HOLDER ASSEMBLY FOR CASE PACKING MACHINE

[75] Inventor: Barry Campbell, Spokane, Wash.

[73] Assignee: R. A. Pearson Company, Spokane, Wash.

Reexamination Request:
No. 90/000,418, Jul. 11, 1983

Reexamination Certificate for:

| | |
|---|---|
| Patent No.: | **4,300,325** |
| Issued: | **Nov. 17, 1981** |
| Appl. No.: | **88,052** |
| Filed: | **Oct. 24, 1979** |

Related U.S. Application Data

[63] Continuation-in-part of Ser. No. 955,350, Oct. 27, 1978, Pat. No. 4,259,826.

[51] Int. Cl.[3] ..... B65B 39/08; B65B 35/56; B65B 5/08

[52] U.S. Cl. ..... 53/143; 53/247; 53/248

[58] Field of Search ..... 198/424, 374, 403, 409, 198/598, 472, 379, 406, 412, 413; 53/544, 248, 48, 261, 262, 143, 497, 539, 543, 247, 300, 142, 69, 80; 294/87.2

[56] References Cited

U.S. PATENT DOCUMENTS

| | | | |
|---|---|---|---|
| 589,226 | 8/1897 | Simmons . | |
| 1,507,387 | 9/1924 | Kyler . | |
| 1,987,789 | 1/1935 | Mudd . | |
| 2,345,560 | 4/1944 | Albertoli . | |
| 2,819,575 | 1/1958 | Ervine . | |
| 2,826,023 | 3/1958 | Bofinger . | |
| 3,184,079 | 5/1965 | Buccicone | 198/403 X |
| 3,313,394 | 4/1967 | Mills et al. | 198/403 X |
| 3,984,964 | 10/1976 | Stoll | 53/544 X |
| 4,040,525 | 8/1977 | Tokunaga et al. | 198/374 |
| 4,048,783 | 9/1977 | Raudat et al. | 198/403 X |

*Primary Examiner*—Horace M. Culver

[57] ABSTRACT

A holder assembly is described for releasably receiving and supporting successive groups of containers in a case packing machine. The machine is operable to move successive groups vertically downward from a first station to the holder assembly at a second station. Subsequently the containers are forced downwardly again from the holder assembly to a case packing station below. The holder assembly functions to group received containers into defined rectangular clusters. The holder assembly also permits vertical movement of the containers while holding them in the rectangular array. Rotary mechanisms enable selective inversion of the holders and containers supported within.

REEXAMINATION CERTIFICATE ISSUED UNDER 35 U.S.C. 307.

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 12, and 15 are determined to be patentable as amended:

Claims 2–11, 13, 14, and 16–19, dependent on amended claims, are determined to be patentable.

1. In a case packing machine for moving successive groups of containers lengthwise from a first station to a spaced second station and subsequently to a case packing station along a case packing framework, a holder assembly for releasably receiving and supporting a group of containers in a defined rectangular cluster at the second station, comprising:

a hollow box frame *movably mounted* on the case packing framework at the second station and having opposed open ends *adapted to alternately face upwardly and downwardly, said box frame permitting passage of a group of containers through either of its open ends while the containers are moved vertically into or out from the box frame in a single direction or in opposite directions relative to the box frame;* fixed guide means arranged within the box frame perpendicular to its open ends for slidably engaging the side surfaces of [a plurality of] *individual* containers passing as a group [in reversible directions alternatively] through [either of] its open ends;

and spring biased guide means movably mounted within the box frame and spaced from the fixed guide means [to urge] *for urging* the [received] containers individually against the fixed guide means *while passing through the open ends of the box frame* and [to] *for* frictionally [engage] *engaging* the containers in a defined rectangular cluster *while* supported within the box frame.

12. In a machine for moving successive groups of bottles having cylindrical side surfaces, a holder assembly for receiving and supporting a group of [containers] *bottles* in a defined cluster, comprising:

a supporting framework;

a hollow frame movably mounted on the framework, said frame having opposed open ends *adapted to alternately face upwardly and downwardly, each open end of the frame being* adapted to both receive and discharge groups of bottles passing *vertically* as a group *in a single direction or in opposite directions relative to the frame;* [in reversible directions alternatively through either open end;]

and spring biased means on said frame for frictionally gripping the cylindrical side walls of each bottle received within the frame and for maintaining it within a defined cluster during subsequent movement of the frame relative to the framework.

15. In a machine for moving successive groups of bottles having cylindrical side walls, a holder for receiving and supporting a group of [containers] *bottles* in a defined cluster, comprising:

a supporting framework;

a hollow rectangular box frame *movably mounted on said supporting framework and* having a pair of transversely spaced side walls spanned by end walls, said side walls and end walls having open peripheral edges about opposed open ends *adapted to alternately face upwardly and downwardly, and permitting passage of a group of bottles through either of its open ends while the bottles are received or discharged vertically in a single direction or in opposite directions relative to the box frame;* a center dividing wall extending parallel to the side walls of the box frame between said pair of end walls;

spring biased guides mounted within the box frame alongside the path of movement of each bottle *within* [received or discharged in reversible directions alternatively through either of the open ends of] the box frame, said guides each having an inwardly facing surface adapted to frictionally engage the cylindrical side walls of a bottle located within the box frame.

* * * * *